US007129922B2

(12) United States Patent
Shin

(10) Patent No.: US 7,129,922 B2
(45) Date of Patent: Oct. 31, 2006

(54) LIQUID CRYSTAL DISPLAY PANEL AND LIQUID CRYSTAL DISPLAY THEREOF

(75) Inventor: Seob Shin, Tao-Yuan Hsien (TW)

(73) Assignee: Hannstar Display Corporation, Taipei (TW)

( * ) Notice: Subject to any disclaimer, the term of this patent is extended or adjusted under 35 U.S.C. 154(b) by 250 days.

(21) Appl. No.: 10/427,627

(22) Filed: Apr. 30, 2003

(65) Prior Publication Data

US 2004/0217931 A1 Nov. 4, 2004

(51) Int. Cl.
*G09G 3/36* (2006.01)

(52) U.S. Cl. ..... 345/90; 345/87; 345/92

(58) Field of Classification Search ..... 345/87–95, 345/97–100, 103, 204, 206, 211, 214; 349/42–48, 349/100, 151

See application file for complete search history.

(56) References Cited

U.S. PATENT DOCUMENTS

| | | | | |
|---|---|---|---|---|
| 5,448,258 | A * | 9/1995 | Edwards | 345/90 |
| 5,701,166 | A * | 12/1997 | Fedorovish et al. | 349/38 |
| 5,903,249 | A * | 5/1999 | Koyama et al. | 345/92 |
| 6,392,620 | B1 | 5/2002 | Mizutani et al. | |
| 2001/0003448 | A1 | 6/2001 | Nose et al. | |
| 2003/0001983 | A1 | 1/2003 | Nose | |

FOREIGN PATENT DOCUMENTS

| | | |
|---|---|---|
| EP | 04000984 | 7/2005 |
| JP | 09127917 A | 5/1997 |
| JP | 11030789 A | 2/1999 |

OTHER PUBLICATIONS

Nose, et al., "35.3: A Black STripe Driving Scheme for Displaying Motion Pictures on LCDs", SID 01 Digest, pp. 994997.

* cited by examiner

*Primary Examiner*—Ricardo Osorio
*Assistant Examiner*—Mansour M. Said
(74) *Attorney, Agent, or Firm*—Seyfarth Shaw LLP

(57) ABSTRACT

A liquid crystal display has a plurality of pixels arranged in a matrix to be formed on a transparent insulating substrate. A first switching element formed in each pixel is a three-terminal TFT whose gate terminal is connected to the scanning line and two other terminals are respectively connected to a pixel electrode and a signal line. Furthermore, a second switching element formed in each pixel is a three-terminal TFT whose gate terminal is connected to a black selecting line and two other terminals are respectively connected to the pixel electrode and a common electrode.

21 Claims, 7 Drawing Sheets

LIQUID CRYSTAL DISPLAY PANEL AND LIQUID CRYSTAL DISPLAY THEREOF

BACKGROUND OF THE INVENTION

1. Field of the Invention

The present invention relates to a liquid crystal display (LCD) panel and a liquid crystal display thereof, and more particularly to an active matrix LCD suitable for displaying a dynamic image.

2. Description of the Related Art

The manufacturing technique for LCDs has progressed in the manufacture of high contrast displays with a wide view angle. However, for the dynamic image which displays a continuous movement, the image quality deteriorates due to a residual image phenomenon. Recently, there have been many relative driving methods to improve the image quality of LCDs, and the black data insertion method provided by NEC Corporation is one suitable solution upon the dynamic image issue. The prior art applies the voltage of a black datum in a sequence to the Liquid crystal (LC) capacitor of each pixel during a frame period so as to have an "impulse-type" effect on the same display as a cathode ray tube (CRT) does. Therefore, a user can never see an image displayed at a certain time overlapped with a previous image.

FIG. 1 shows the configuration of an LCD 10 and the gate pulses of a signal line and scanning lines in accordance with the U.S. Publication No. 2003/0001983. The scanning signals VG1–VGn sequentially input to their corresponding scanning lines G1–Gn 12, and a data signal VD for displaying an image inputs to a signal line D1 13. The scanning signals VG1–VGn all comprise two main gate pulses 111 and 112 during a vertical scanning period. The gate pulse 111 is applied to the scanning signal VG1 for selecting a thin film transistor (TFT) 141 so as to write a display datum 181 to the pixel electrode 151. Meanwhile, that the voltage of the pixel electrode 151 referring to the potential Vcom of a common electrode 16 is positive is defined as a positive polarity in the pixel. The scanning signals VG1–VGn, data signal VD, and potential Vcom are output from a driving circuit, which comprises a plurality of driving devices and logic devices. After the gate pulse 111 applied to the scanning line VG1 falls, the gate pulse 112 is next applied to the scanning signal VGj to turn on the TFT 142 and a black datum 182 is enabled to write a pixel electrode 152. At the same time, the display of the pixel corresponding to the pixel electrode 152 turns black from a gradation in a previous frame.

When the gate pulse 111 of the scanning signal VG1 enables the scanning line G1 of the first pixel line, the gate pulse 111 of the scanning signal VG2 will follow to enable the scanning line G2 of the second pixel line. The display datum 183 will be allowed to write a pixel electrode 152. Simultaneously, that the voltage of the pixel electrode 151 referring to the potential Vcom of a common electrode 16 is negative is defined as a negative polarity in the pixel. A black datum 184 following the display datum 183 will write the scanning line Gj+1 of the corresponding pixel line after the gate pulse 112 of the scanning signal VGj+1 outputs. In general cases, the outputs of the black data insertion and the display data are simultaneously executed far from one half of the frame period on the LCD 10. Due to the lack of sufficient charging time for writing a black datum to a LC capacitor, a plurality of the gate pulses 112 have to be separately applied to the scanning lines 12 so as to make the corresponding pixels turn true black.

FIG. 2 is a gate pulse diagram showing the datum signals and scanning signals in accordance with FIG. 1. In fact, the RC delay arises in the transmission of the scanning signal, which is especially relevant to the LCD with a large size or high resolution. A square gate pulse 111 gradually becomes a distorted gate pulse 111' on the scanning line 12 at the end of the transmission. In other words, the existence of the gate delay will shorten the actually working time of a display datum, and TFT is delayed to completely turn itself off. For example, a WUGAN LCD (1,920×1,200 pixels) is suitable for a high definition television (HDTV), and the time H between the gate pulses 111 separately output from one scanning line and the next is no more than 13.3 μsecs. It is necessary to satisfy the equation of H=t1+t2+t3+t4, wherein t2 of the distorted gate pulse 111' and t4 of the distorted gate pulse 112' represent the gate delay times and thereof shorten the actually working times t1 of a display datum 181 and t3 of a black datum 182.

| | t1 | t2 | t3 | t4 |
|---|---|---|---|---|
| Case 1 | 5 μsecs | 2.5 μsecs | 3.3 μsecs | 2.5 μsecs |
| Case 2 | 4 μsecs | 3 μsecs | 3.3 μsecs | 3 μsecs |

In Case 1 of the above table, t2 and t4 are equal to 2.5 μsecs, and t1 and t3 are separately equal to 5 μsecs and 3.3 μsecs, respectively. In Case 2, t2 and t4 are equal to 3 μsecs, and t1 and t3 are separately equal to 4 μsecs and 3.3 μsecs, respectively. The definition of t1, t2, t3 and t4 are shown in FIG. 2. In conclusion, the prior art limits the charging time of the LC capacitor to the critically write-in time of a display datum 181, so the image quality deteriorates due to this limitation. Such an insufficient charging time is the bottleneck of upgrading the size and resolution of an LCD.

SUMMARY OF THE INVENTION

The first object of the present invention is to increase the charging time of a display datum on the LCD with a high resolution by adding a TFT in each pixel to enable a black voltage to be written in the corresponding LC capacitor.

The second object of the present invention is to provide an LCD using a common signal driver rather than one with a special specification to have an "impulse-type" display suitable for a dynamic image. The third object of the present invention is to have an LCD with a fast response on the black data insertion.

In order to achieve these objects, the present invention discloses an LCD panel having a plurality of pixels arranged in a matrix to be formed on a transparent insulating substrate. A first switching element formed in each pixel is a three-terminal TFT whose gate terminal is connected to the scanning line and two other terminals are respectively connected to a pixel electrode and a signal line. Furthermore, a second switching element formed in each pixel is a three-terminal TFT whose gate terminal is connected to a black selecting line and the two other terminals are respectively connected to the pixel electrode and a common electrode.

A driving circuit of an LCD outputs start vertical signals for instructing each scanning line and each black selecting line to start scanning. A second gate pulse from the black selecting line to short the pixel electrode and the common electrode succeeds a first gate pulse from the scanning line to turn on the first switching element during a vertical scanning period.

BRIEF DESCRIPTION OF THE DRAWINGS

The invention will be described according to the appended drawings in which.

PREFERRED EMBODIMENT OF THE PRESENT INVENTION

Figure 1:
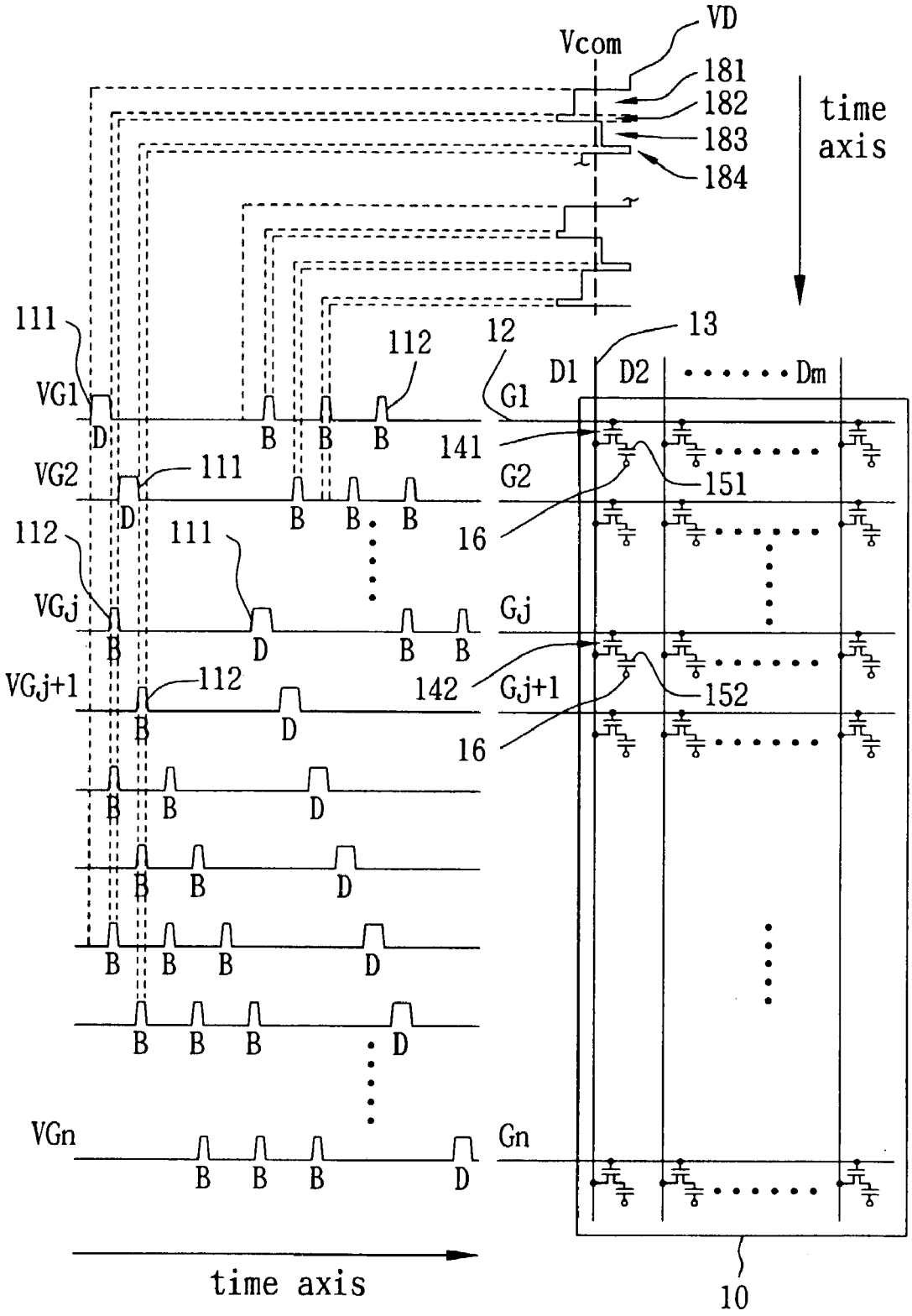
FIG. 1 (Background Art)
FIG. 1 shows the configuration of an LCD and the gate pulses output from a signal line and scanning lines in accordance with the U.S. Publication No. 2003/0001983.
Figure 2:
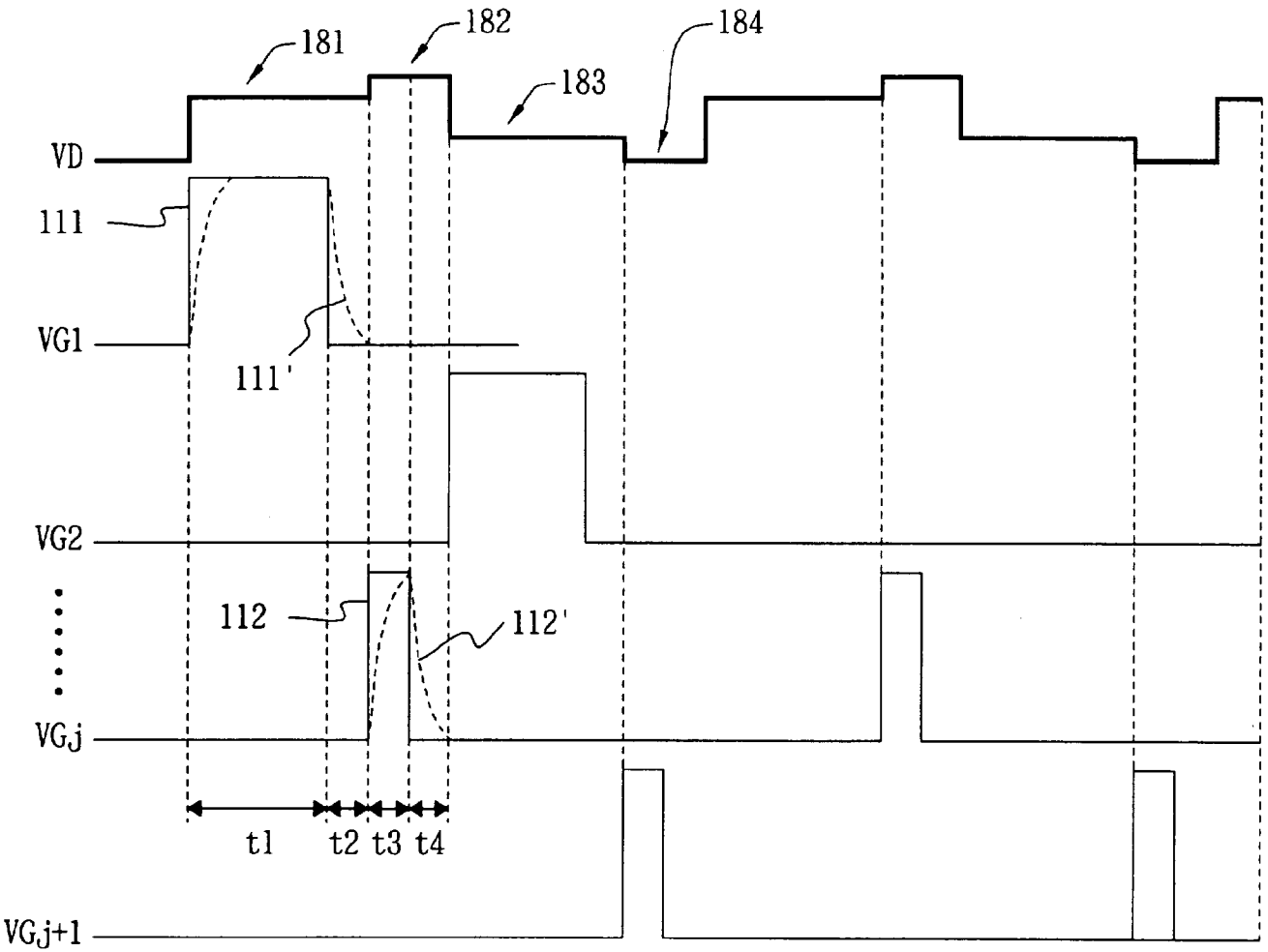
FIG. 2 (Background Art)
FIG. 2 shows the gate pulses output from a signal line and scanning lines in accordance with FIG. 1.
Figure 3:
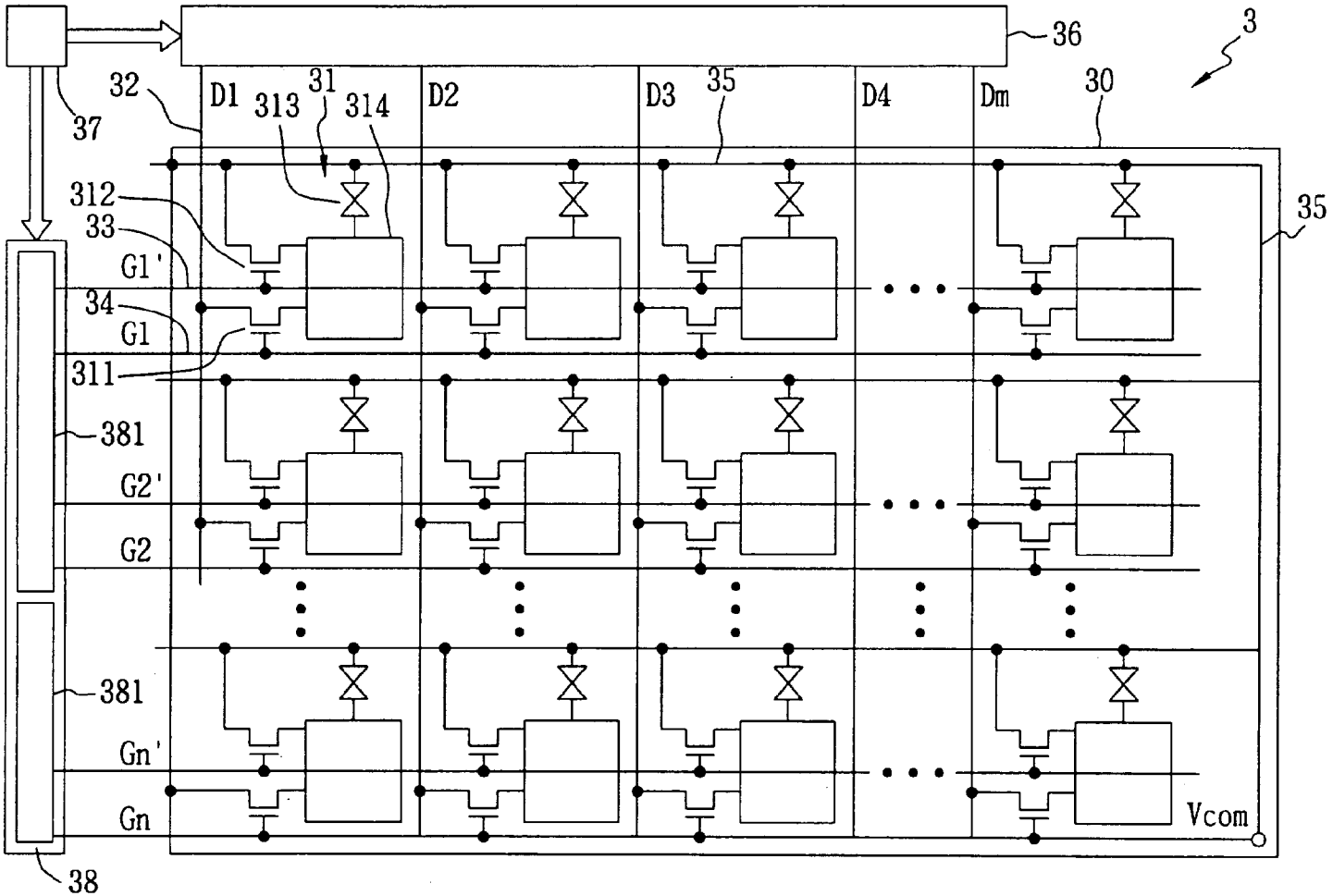
FIG. 3 shows the configuration of an LCD.

Please refer to FIG. 3, which shows the configuration of an LCD 3 in accordance with the embodiment of the present invention. The scanning lines, G1–Gn 34, are formed on a transparent insulating substrate such as a glass substrate in a transverse direction. The black selecting lines, G1'–Gn' 33, which are accompanied with the scanning lines, G1–Gn 34, in parallel, goes across each row of pixels on the LCD panel 30.

A first switching element formed in the pixel 31 is named as a first TFT 311 whose gate terminal is connected to the scanning line, G1 311, and two other terminals are respectively connected to a pixel electrode 314 and the signal line, D1 32. A second switching element also formed in the pixel 31, is named as a second TFT 312 whose gate terminal is connected to the black selecting line, G1' 33, and the other two terminals are respectively connected to the pixel electrode 314 and a common electrode 35. The electrical field in the LC capacitor 313, whose two terminals are respectively connected to the pixel electrode 314 and the common electrode 35, can control the orientation of the LC molecules filled therebetween.

The gate drivers 381 of a scanning line driving circuit 38 drives the scanning lines, G1–Gn 34, to execute scanning actions by sequentially applying high voltage as a gate pulse to turn on each first TFT 311, and then a gradation voltage is written to the pixel electrode 314 when the signal line 32 outputs the gradation voltage. During the same vertical scanning period, after the gradation voltage being written in the pixel electrode 314, the black selecting lines, G1'–Gn' 33, driven by the gate drivers 381, sequentially apply another high voltage as a black selecting pulse to turn on each second TFT 312, so as to electrically conduct the pixel electrode 314 and the common electrode 35. A signal line driving circuit 36 drives the signal lines, D1–Dm 32, to output the signal data, and an LCD controller 37 can control the signal line driving circuit 36 and the scanning line driving circuit 38.

Figure 4:
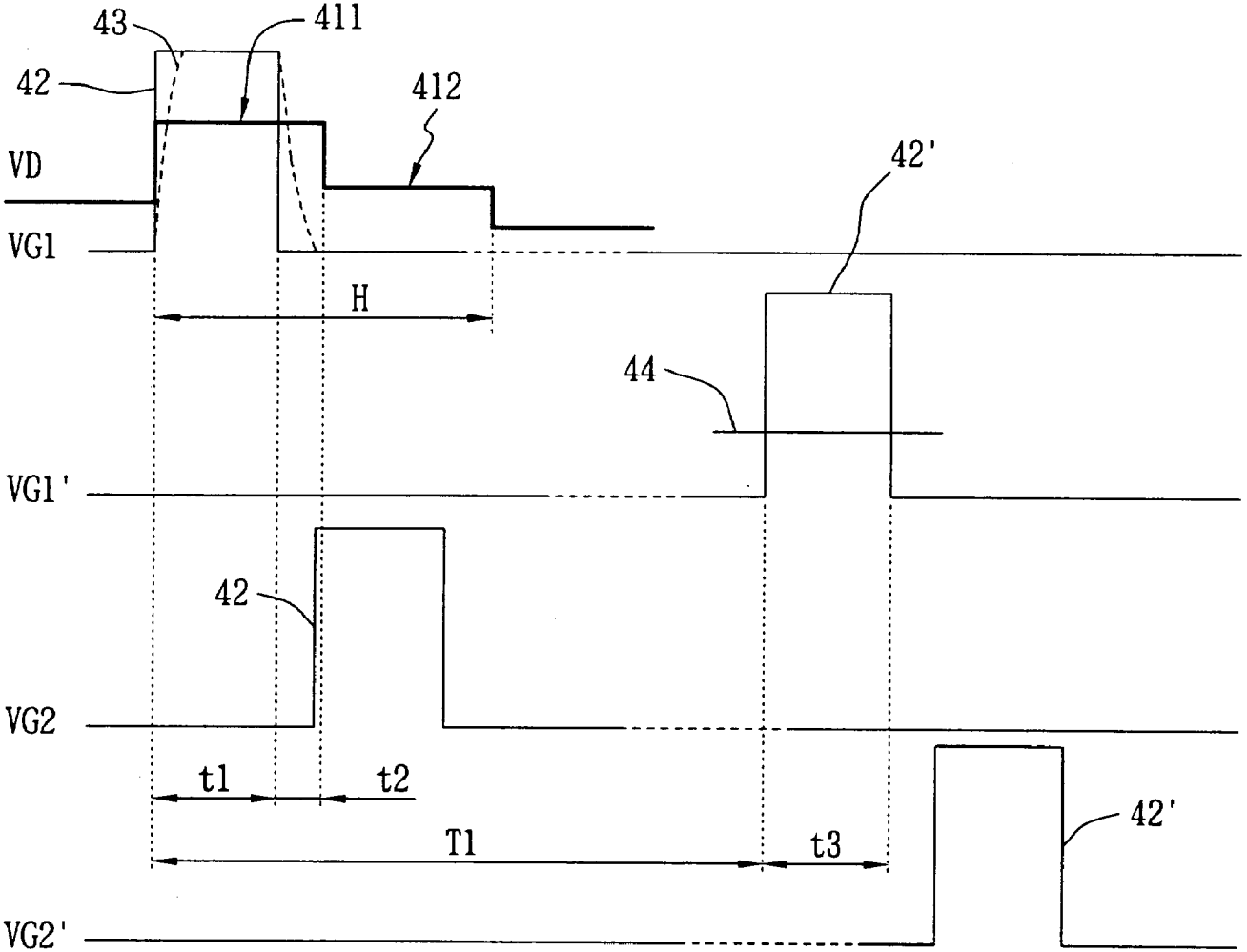
FIG. 4 shows the gate pulses input to the signal line, scanning lines and black selecting lines.

FIG. 4 shows the gate pulses of the signal line, scanning lines and black selecting lines. The symbols VG1–VG2 respectively represent the gate pulse of a scanning signal applied to each of the scanning lines, G1–G2 34, and the symbols VG1'–VG2' respectively represent the gate pulses of a black selecting pulse applied to each of the scanning lines, G1–G2 34. The symbol VD shows the gate pulse of the signal line, D1 32. In the time interval t1, a gate pulse 42 is applied to the scanning line, G1 34. Meanwhile, the voltage of a display datum 411 is allowed to write the first TFT 311 in the pixel 31.

In further consideration of the aforementioned delay effect, the gate pulse 42 gradually becomes a distorted gate pulse 43 on the scanning line 34 at the end of the transmission. To prevent the cross-talk effect caused by the distorted gate pulse 43, it is necessary to place a time interval t2 after the time interval t1. After the time interval t2, a display datum 412 succeeds the display datum 411 shown in the data signal VD. After a time interval T1, the voltage of a display datum 411 completely charges the LC capacitor 313, and then a black selecting pulse 42' selects the second TFT 312 in the same pixel 31 to turn itself on. The time interval T1 is suggested to be around a half of the frame period, wherein one frame period is equal to one vertical scanning period. When the second TFT 312 is turned on, the pixel electrode 314 and the common electrode 35 will electrically contact with each other. Therefore, the pixel electrode 314 and the common electrode 35 have the same potential, Vcom 44. That is, the display of the pixel 31 will turn black from the gradation defined by the display datum 411.

The time interval H is around 13.3 μsecs in a UXGAN LCD (60 Hz) as described in description of the related art. However, the time interval H is only occupied by t1 and t2 in the present invention, not including t3 and t4. In comparison with the prior art, the time interval H of the present invention deducts the time t3 and t4 of inserting the black data. Therefore, the charging time t1 of the display datum 411 can last 10 μsecs, more than 5 μsecs in Case 1 of the prior art. On the other hand, the black charging time t3 is suggested to be equal to t1 so that the display of the pixel 31 will have sufficient time to turn true black. Furthermore, the response to turn true black of the present invention is faster than that of prior art due to the short circuit of the pixel electrode 314 and the common electrode 35 when the second TFT 312 is turned on.

Figure 5:
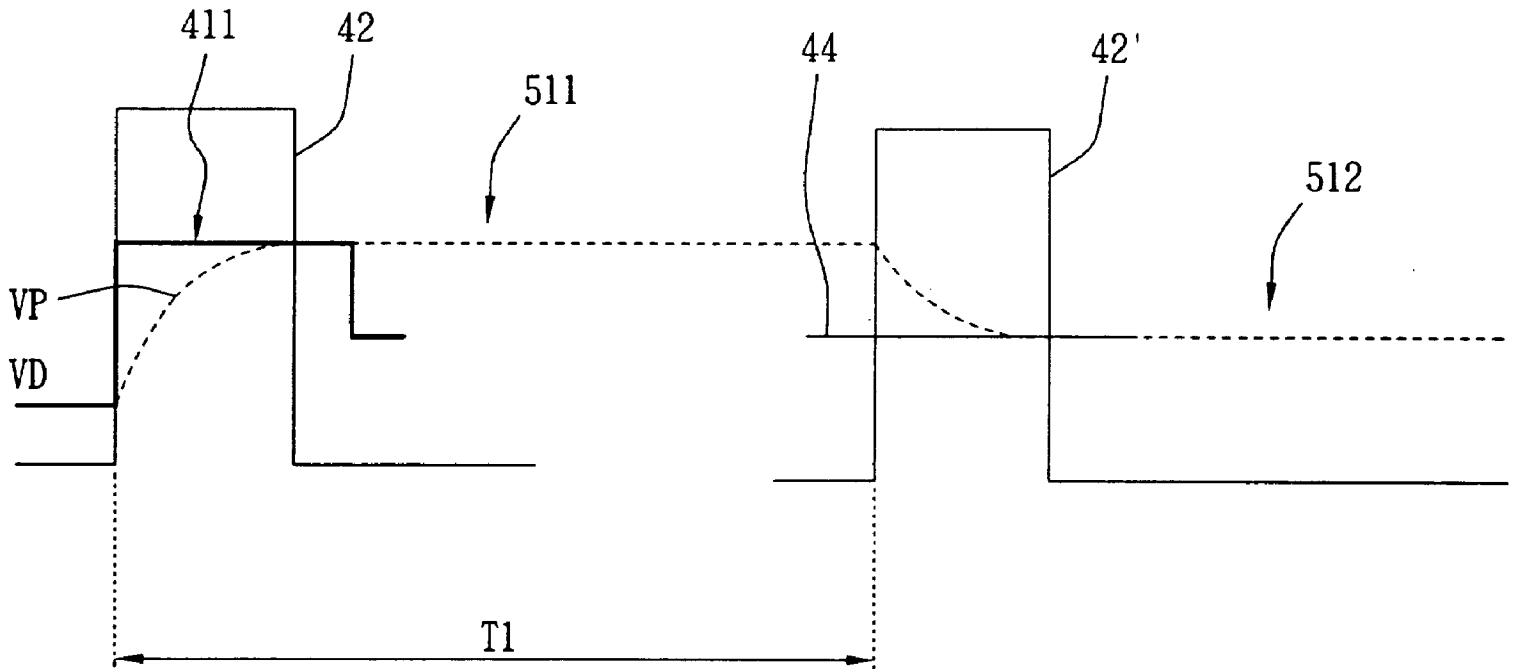
FIG. 5 shows the gate pulses of the pixel electrode in accordance with FIG. 4.

FIG. 5 shows the gate pulses of the pixel electrode in accordance with FIG. 4. The potential VP of the pixel electrode 31 can be fully charged to the same potential as the display datum 411 till the end of time interval T1. When the black selecting pulse 42' is applied, the potential VP instantly changes to the potential, Vcom 44.

Figure 6:
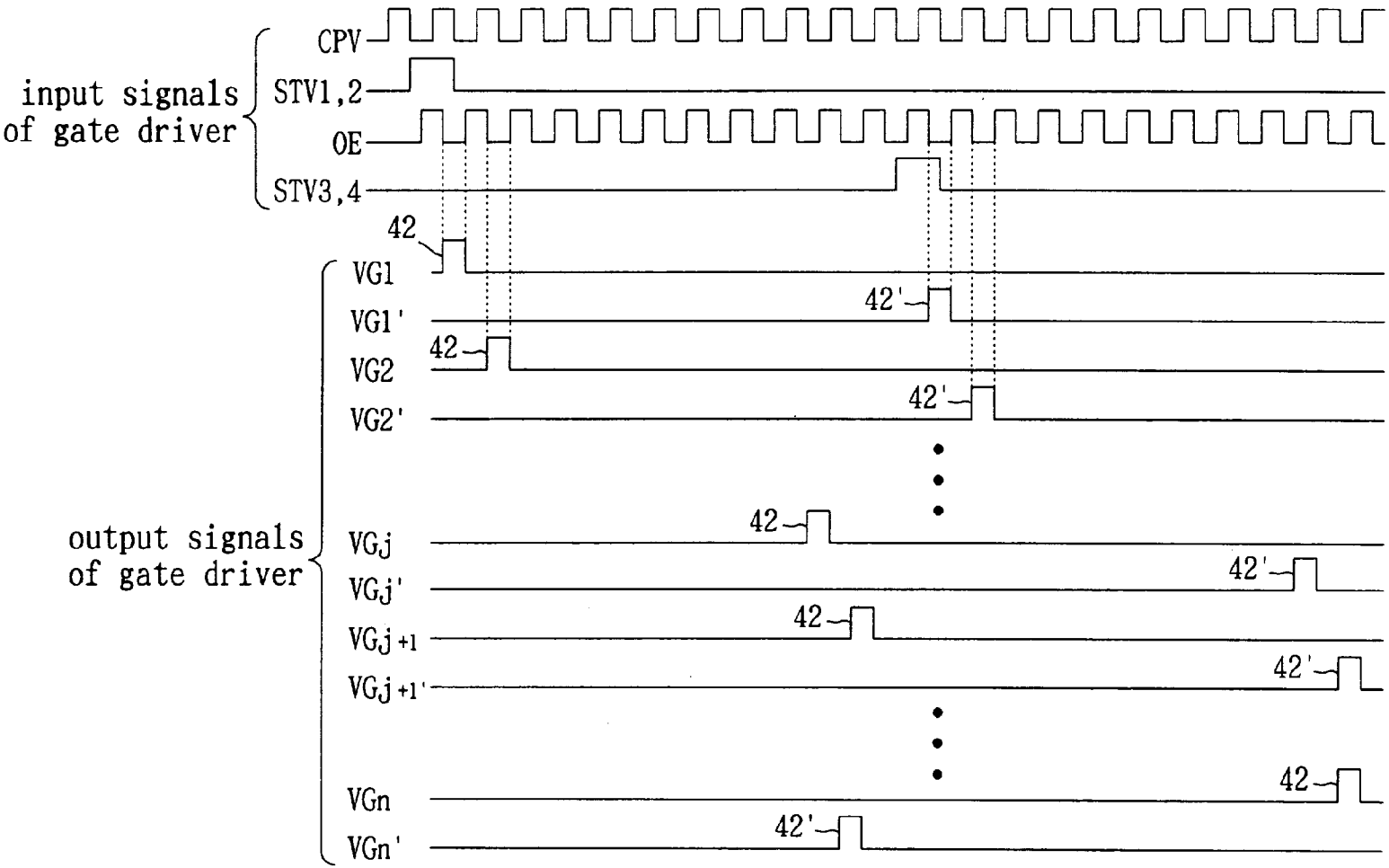
FIG. 6 shows a timing chart of various signals output from a gate driver in accordance with the present invention.

The LCD 3 is provided with a corresponding modified gate driver 381 in the scanning line driving circuit 38 for driving each scanning line 34 and each black selecting line 33 to transmit signals. FIG. 6 shows a timing chart of various signals output from a gate driver 381 in accordance with the present invention. A start vertical signal STV, a gate clock signal CPV and an output enable signal OE are output from the LCD controller 37. The start vertical signals STV1 and STV2 are respectively for instructing each of the gate drivers 381 to start scanning the scanning lines 34 by the scanning signals VG1–VGn, and the start vertical signals STV3 and STV4 are respectively for instructing each of the gate drivers 381 to output the black selecting pulses VG1'–VGn' to the black selecting lines 33. The output enable signal OE are for controlling whether or not one scanning line 34 or one black selecting line 33 is activated or deactivated in a period for scanning one.

Figure 7:
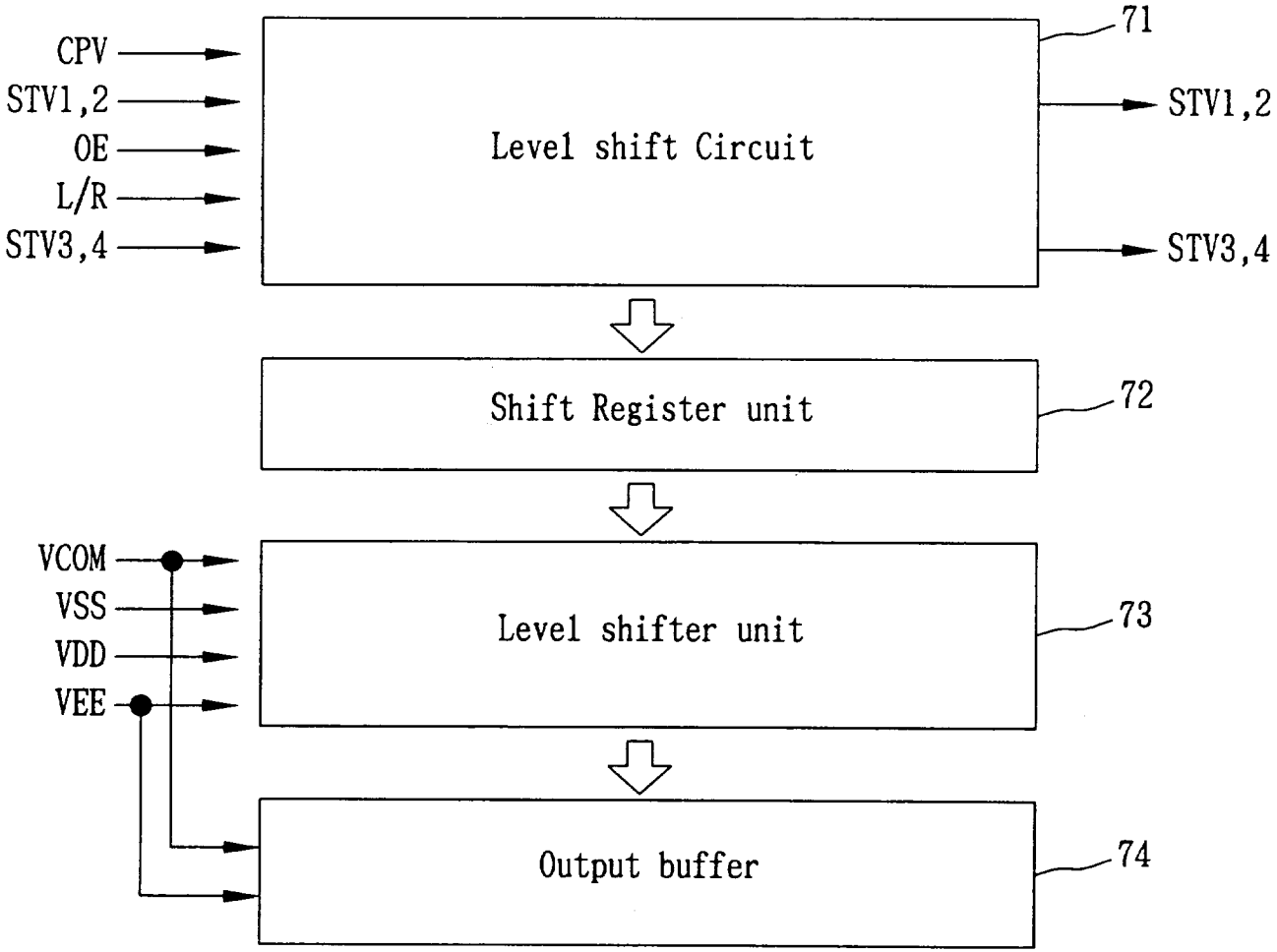
FIG. 7 shows a functional block diagram in accordance with a gate driver of the present invention.

FIG. 7 shows a functional block diagram in accordance with the gate driver 381 of the present invention. The gate driver 381 includes a level shift circuit 71, a shift register unit 72, a level shifter unit 73 and an output buffer 74. The signals CPV, STV1 or STV2, OE, L/R and STV3 or STV4 are input from the LCD controller 37 to the level shift circuit 71. If the shift direction switching signal L/R="L", STV1,2 and STV3,4 will shift data in based on the synchronization of the OE signal and CPV clock signal. When the shift direction-switching signal L/R is set "H", the directions of STV1,2 and STV3,4 are then inverse.

The level shift circuit (or called first level shifter) 71 changes the potential of an external signal, such as OE, into a potential required for the internal operation of the gate driver 381. The shifter register unit 72 is provided with a plurality of shift registers, and each operation in response to a signal potential changed by the level shift circuit 71 for shifting a scanning signal applied to the scanning line 34 in a sequence. The level shifter unit 73 is provided with a plurality of level shifters, each for shifting a potential of driving signal from the shifter register unit 72 to a potential Vcom or Vss. The output buffer 74 outputs signals that are applied to the scanning line in a sequence. For example, initially when a first buffer provides a high signal Vcom ($V_H$) the remaining buffers provides a low signal $V_L$. Then, the output buffer 74 is shifted so that a second buffer will provide a high signal Vcom while the remaining buffers, including the first buffer, provides a low signal $V_L$. VDD and VSS are supplied to the level shifter unit 73 from an external power source. VSS and VEE are supplied to either the level shifter unit 73 or output buffer 74 also from an external power source. The VEE is used for the compensation of the voltage of the pixel electrode 314 in the gate pulse of the scanning signal. Logic input and logic output, such as STV1,2 and STV3,4, should be the amplitude of VDD to VSS. The scanning signal, such as VG1–VGn and VG1'–VGn', should be the amplitude of Vcom to $V_L$ (or $V_{EE}$, especially for the three-level driving device).

The above-described embodiments of the present invention are intended to be illustrative only. Numerous alternative embodiments may be devised by persons skilled in the art without departing from the scope of the following claims.

What is claimed is:

1. A liquid crystal display panel, comprising:
a plurality of first scanning lines;
a plurality of second scanning lines;
a plurality of signal lines;
a common electrode; and
a plurality of pixels arranged in a matrix, each pixel bounded by a pair of the first scanning lines and a pair of the signal lines, each pixel including:
a pixel electrode;
a first switch element a gate terminal of the first switch element connected to one first scanning line and two other terminals of the first switch element electrically connected to the pixel electrode and one signal line; and
a second switch element, a gate terminal of the second switch element connected to one second scanning line and two other terminals of the second switch element directly connected to the pixel electrode and the common electrode.

2. The liquid crystal display panel of claim 1, wherein the first switch element is a thin film transistor.

3. The liquid crystal display panel of claim 1, wherein the second switch element is a thin film transistor.

4. The liquid crystal display panel of claim 1, wherein a gradation voltage of the signal line connected to the first switch clement writes the pixel electrode of the first switch element when the first switch element is selected.

5. The liquid crystal display panel of claim 1, wherein the pixel electrode of the second switch element electrically contacts the common electrode when the second switch element is selected.

6. A liquid crystal display panel, comprising a plurality of pixels arranged in a matrix, each pixel including:
a pixel electrode;
a common electrode;
a first scanning line;
a second scanning line;
a signal line;
a first tin film transistor, a gate terminal of the first thin film transistor connected to the first scanning line and two other terminals of the first thin film transistor electrically connected to the pixel electrode and the signal line; and
a second thin film transistor, a gate terminal of the second thin film transistor connected to the second scanning line and two other terminals of the second thin film transistor directly connected to the pixel electrode and the common electrode.

7. The liquid crystal display panel of claim 6, wherein each pixel further comprises an LC capacitor between the common electrode and the pixel electrode.

8. A liquid crystal display, comprising:
a liquid crystal display panel, wherein the liquid crystal display panel including:
a plurality of first scanning lines;
a plurality of second scanning lines;
a plurality of signal lines;
a common electrode; and
a plurality of pixels arranged in a matrix, each pixel bounded by a pair of the first scanning lines and a pair of the signal lines, each pixel including:
a pixel electrode;
a first switch element, a gate terminal of the first switch element connected to one first scanning line and two other terminals of the first switch element electrically connected to the pixel electrode and one signal line; and
a second switch element, a gate terminal of the second switch element connected to one second scanning line and two other terminals of the second switch element directly connected to the pixel electrode and the common electrode;
a driving circuit outputting signals to the liquid crystal display panel to for displaying images.

9. The liquid crystal display of claim 8, wherein the driving circuit comprises a scanning line driving circuit, a signal line driving circuit and an LCD controller.

10. The liquid crystal display of claim 9, wherein the scanning line driving circuit first drives the first scanning lines and then drives the second scanning lines.

11. The liquid crystal display of claim 10, wherein the scanning line driving circuit comprises a plurality of gate driven for driving the first scanning lines and the second scanning lines.

12. The liquid crystal display of claim 8, wherein the first switch element is a thin film transistor.

13. The liquid crystal display of claim 8, wherein the second switch element is a thin film transistor.

14. The liquid crystal display of claim 8, wherein the second switch element is selected for electrically connecting the pixel electrode and the common electrode.

15. A liquid crystal display, comprising:
a liquid crystal display panel, wherein the liquid crystal display, panel including:
a plurality of first scanning lines;
a plurality of second scanning lines;
a plurality of signal lines;
a common electrode; and a plurality of pixels ranged in a matrix, each pixel bounded by a pair of the first scanning lines and a pair of the signal lines, each pixel including:

a pixel electrode;

a first switch element, a gate terminal of the first switch element connected to one first scanning line and two other terminals of the first switch element electrically connected to the pixel electrode and one signal line;

a second switch element, a gate terminal of the second switch element connected to one second scanning line and two other terminals of the second switch element electrically connected to the pixel electrode and the common electrode; and a driving circuit outputting signals to the liquid crystal display panel to for displaying images, wherein the driving circuit includes a scanning line driving circuit, a signal line driving circuit and an LCD controller; and wherein the LCD controller outputs start vertical signals for instructing the scanning line driving circuit to sequentially output gate pulses to the first scanning lines and output blacking selecting pulses to the second scanning lines.

16. The liquid crystal display of claim 15, wherein an interval between the gate pulse and the black selecting pulse separately applied to the same pixel in a frame period is around one half of the frame period.

17. The liquid crystal display of claim 15, wherein the scanning line driving circuit first drives the first scanning lines and then drives the second scanning lines.

18. The liquid crystal display of claim 17, wherein the scanning line driving circuit comprises a plurality of gate drivers for driving the first scanning lines and the second scanning lines.

19. The liquid crystal display of claim 15, wherein the first switch element is a thin film transistor.

20. The liquid crystal display of claim 15, wherein the second switch element is a thin film transistor.

21. The liquid crystal display of claim 15, wherein the second switch element is selected for electrically connecting the pixel electrode and the common electrode.

* * * * *

UNITED STATES PATENT AND TRADEMARK OFFICE

CERTIFICATE OF CORRECTION

PATENT NO. : 7,129,922 B2
APPLICATION NO. : 10/427627
DATED : October 31, 2006
INVENTOR(S) : Seob Shin It is certified that error appears in the above-identified patent and that said Letters Patent is hereby corrected as shown below:

Column 6

Claim 6, line 8; "tin" should be --thin--.

Claim 11, line 52; "driven" should be --drivers--.

Column 7

Claim 15, line 1; "ranged" should be --arranged--.

Claim 15, line 12; after "element" should be --directly--.

Column 14,

Claim 8; line 31, "papet" should be --paper--

Signed and Sealed this

Thirtieth Day of January, 2007

JON W. DUDAS
*Director of the United States Patent and Trademark Office*